US008641303B2

(12) United States Patent
Sano et al.

(10) Patent No.: US 8,641,303 B2
(45) Date of Patent: Feb. 4, 2014

(54) IMAGE RECORDING APPARATUS

(75) Inventors: Iwane Sano, Nagoya (JP); Yasuhira Ota, Yatomi (JP); Shota Iijima, Nagoya (JP); Naokazu Tanahashi, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 480 days.

(21) Appl. No.: 13/017,505

(22) Filed: Jan. 31, 2011

(65) Prior Publication Data

US 2011/0188916 A1 Aug. 4, 2011

(30) Foreign Application Priority Data

Jan. 29, 2010 (JP) ..... 2010-019590

(51) Int. Cl.
*B41J 11/20* (2006.01)
*B65H 5/36* (2006.01)

(52) U.S. Cl.
USPC ..... 400/58; 400/642

(58) Field of Classification Search
USPC ..... 400/55–59, 578, 642; 347/8, 104; 271/3.14, 9.09
See application file for complete search history.

(56) References Cited

U.S. PATENT DOCUMENTS

| | | | | |
|---|---|---|---|---|
| 6,869,235 | B2 * | 3/2005 | Kawaguchi et al. | 400/59 |
| 8,351,839 | B2 * | 1/2013 | Matsumoto | 399/361 |
| 2004/0017459 | A1 | 1/2004 | Kawaguchi et al. | |
| 2006/0181566 | A1 * | 8/2006 | Miyashita et al. | 347/20 |
| 2007/0025794 | A1 * | 2/2007 | Kubin et al. | 400/605 |
| 2008/0278523 | A1 | 11/2008 | Uchida | |

FOREIGN PATENT DOCUMENTS

| | | | |
|---|---|---|---|
| JP | H08-156352 | A | 6/1996 |
| JP | H08-267857 | A | 10/1996 |
| JP | H10-297038 | A | 11/1998 |
| JP | H11-115167 | A | 4/1999 |
| JP | 2002-362766 | A | 12/2002 |
| JP | 2004-042392 | A | 2/2004 |
| JP | 2006-036516 | A | 2/2006 |
| JP | 2007-030304 | A | 2/2007 |
| JP | 2007-136802 | A | 6/2007 |
| JP | 2008-132628 | A | 6/2008 |
| JP | 2008-280126 | A | 11/2008 |
| JP | 2009-274880 | A | 11/2009 |

OTHER PUBLICATIONS

Japan Patent Office, Decision to Grant a Patent for Japanese Patent Application No. 2010-019590 (counterpart Japanese patent application), dispatched Feb. 26, 2013.

* cited by examiner

*Primary Examiner* — Ren Yan
*Assistant Examiner* — Marissa Ferguson Samreth
(74) *Attorney, Agent, or Firm* — Baker Botts L.L.P.

(57) ABSTRACT

An image recording apparatus including: a first convey path; a support member which supports a first recording medium, a second recording medium, and a tray; a second convey path connected to the first convey path; a first guide member partly defining the second convey path; and a posture change mechanism which changes the support member and the first guide member between (a) a first posture in which the first convey path has a height allowing the first recording medium to pass therethrough, and the second convey path has a height allowing the first recording medium to pass therethrough and (b) a second posture in which the first convey path has a height larger than the first height and allowing the second recording medium or the tray to pass therethrough, and the second convey path has a height smaller than the second height.

10 Claims, 6 Drawing Sheets

IMAGE RECORDING APPARATUS

CROSS REFERENCE TO RELATED APPLICATION

The present application claims priority from Japanese Patent Application No. 2010-019590, which was filed on Jan. 29, 2010, the disclosure of which is herein incorporated by reference in its entirety.

BACKGROUND OF THE INVENTION

1. Field of the Invention

The present invention relates to an image recording apparatus configured to record images on both sides of a recording medium such as a recording sheet and configured to record an image on a recording medium having a relatively high rigidity such as a CD and a DVD.

2. Description of the Related Art

There is conventionally known an image recording apparatus configured to record an image on a recording medium on the basis of an input signal. A type of image recording of such an image recording apparatus includes an ink-jet recording type and an electronic photography type, for example.

As a recording medium on which an image is recorded by the above-described image recording apparatus, a recording medium having a relatively high rigidity such as a CD and a DVD has been proposed in addition to a recording medium having a low rigidity such as a recording sheet. In general, when the image is recorded on the recording medium having a high rigidity, the recording medium is set on a tray specifically for such a recording medium. In this case, the image recording apparatus is often configured such that the tray is inserted from an insertion opening formed in the apparatus and conveyed in the apparatus.

Further, the image recording apparatus of the above-described type includes an image recording apparatus configured to record images on both sides of a recording sheet as a recording medium. As an example of the image recording apparatus of this type, there is a two-side image forming apparatus of an electronic photography type. This two-side image forming apparatus is configured such that a sheet supplied from a sheet-supply portion is fed or conveyed by a convey roller to a recording portion including a photoconductive drum and so on. The image is recorded on a front face of the sheet by the recording portion. After the image has been recorded on the front face of the sheet, the sheet is switched back or fed in an opposite direction by a discharge roller disposed at a position located on a downstream side of the recording portion. The switched-back sheet reaches the convey roller again by passing through a resupply convey path defined on a lower side of the recording portion. The recording portion records an image on a back face of the sheet in the same manner as the image is recorded on the front face of the sheet. Then, the sheet on which the two-side recording has been performed is discharged onto a discharge tray by the discharge roller.

SUMMARY OF THE INVENTION

An image recording apparatus includes a convey roller pair and a discharge roller pair. The convey roller pair is for conveying a recording medium to a recording portion and disposed on an upstream side of the recording portion in a medium conveying direction in which the recording medium is conveyed. The discharge roller pair is for discharging the recording medium on which an image has been recorded by the recording portion and is disposed on a downstream side of the recording portion in the medium conveying direction. Each of the convey roller pair and the discharge roller pair is constituted by a drive roller and a driven roller. The drive roller and the driven roller are held in contact with each other in order to nip and feed a recording sheet as the recording medium.

Meanwhile, as described above, the recording medium having the high rigidity or the tray on which the recording medium of this type is set is inserted from the insertion opening of the image recording apparatus. That is, the tray or the recording medium having the high rigidity is inserted from the insertion opening so as to be conveyed to the recording portion via the convey roller pair or the discharge roller pair.

However, each of the tray and the recording medium having the high rigidity (such as a CD or a DVD) has a thickness greater than that of the recording medium having the low rigidity such as a recording sheet. Thus, where the drive roller and the driven roller are held in contact with each other, each roller pair cannot nip the recording medium having the high rigidity. In order to solve this problem, a mechanism for making the drive roller and the driven roller distant from each other can be employed for the image recording apparatus configured to record the image on the recording medium having the high rigidity.

However, in order to make the drive roller and the driven roller distant from each other, one or both of the drive roller and the driven roller need to be moved upward or downward. Thus, a space for the movement of the drive roller and/or the driven roller is required in the image recording apparatus. As a result, the image recording apparatus is unfortunately upsized.

Further, where the images can be recorded on both faces of the recording sheet as the recording medium as in the case of the above-described two-side image forming apparatus, a space for providing the resupply convey path needs to be formed on a lower side of the recording portion. As a result, the image recording apparatus is unfortunately upsized.

This invention has been developed in view of the above-described situations, and it is an object of the present invention to provide an image recording apparatus which can record an image on a recording medium having a high rigidity and record images on both faces of the recording medium, and which can make a height of the image recording apparatus low.

The object indicated above may be achieved according to the present invention which provides an image recording apparatus comprising: a first convey path defined so as to guide a first recording medium, a second recording medium having a larger thickness than that of the first recording medium, and a tray designed to hold one of the first recording medium and the second recording medium; a recording portion disposed above the first convey path and configured to record an image on the first recording medium and the second recording medium; a support member disposed below the first convey path so as to be opposed to the recording portion, the support member being configured to support the first recording medium, the second recording medium, and the tray; a second convey path connected to the first convey path and extending on a lower side of the support member so as to guide the first recording medium; a first guide member having a guide face located on an upper side of the second convey path so as to partly define the second convey path; a second guide member having a guide face located on a lower side of the second convey path so as to partly define the second convey path; and a posture change mechanism configured to integrally change a posture of the support member and the first guide member between (a) a first posture in which a height of the first convey path in an upward and downward direction is a first height which allows the first recording medium to pass through the first convey path, and a height of the second convey path in the upward and downward direction is a second height which allows the first recording medium to pass through the second convey path and (b) a second posture in which the height of the first convey path in the upward and downward direction is a third height which is larger than the first height and allows the second recording medium or the tray to pass through the first convey path, and the height of the second convey path in the upward and downward direction is a fourth height smaller than the second height.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention. In this embodiment, an upward and downward direction 7 is defined as a top and bottom direction of a multi-function device (MFD) 10 set in a usable state (shown in FIG. 1). A frontward and rearward direction 8 is defined in a state in which a side of the MFD 10 on which an opening 13 is formed is a front side. A rightward and leftward direction 9 is defined in a state in which the MFD 10 is viewed from the front side.

<Multi-Function Device 10>

Figure 1:
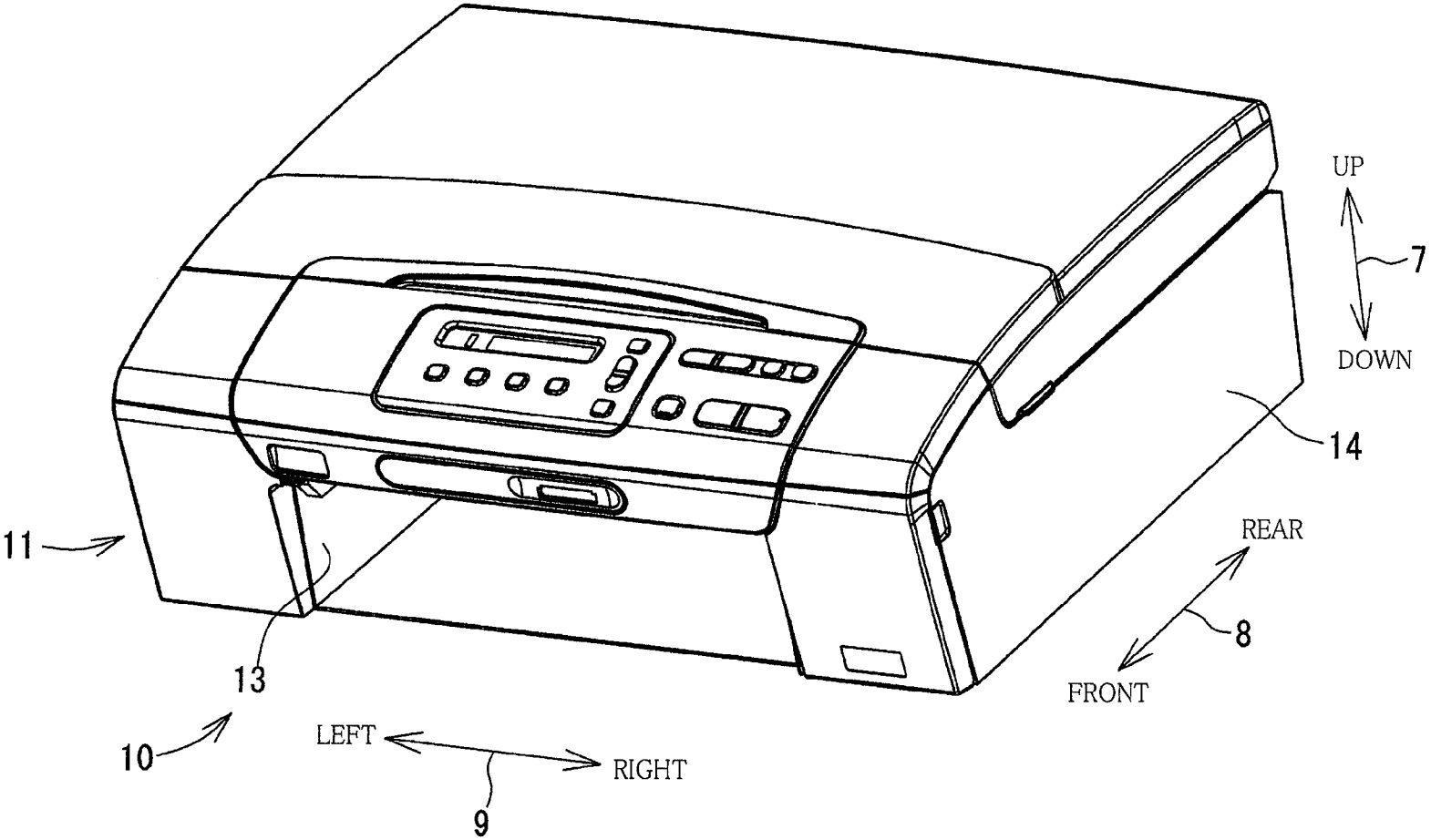
FIG. 1 is an external perspective view showing an MFD 10 as an example of an embodiment of the present invention.

The MFD 10 is an example of an image recording apparatus to which the present invention is applied. As shown in FIG. 1, the MFD 10 is of a slim type having a generally rectangular parallelepiped shape. A printing section 11 of an ink-jet recording type is provided on a lower portion of the MFD 10. The MFD 10 has various functions such as a facsimile function and a printing function. It is noted that functions other than the printing function are optional and accordingly may be omitted.

The printing section 11 includes a casing 14 having the opening 13 on its front side. A sheet-supply tray 20 and a sheet-discharge tray 21 (see FIG. 2) can be inserted or removed through the opening 13 in the frontward and rearward direction 8. A plurality of recording sheets (as first recording media) of desired sizes can be stacked on the sheet-supply tray 20. Further, the sheet-discharge tray 21 is supported and disposed on the sheet-supply tray 20. The trays 20, 21 are mounted in the MFD 10.

<Printing Section 11>

Figure 2:
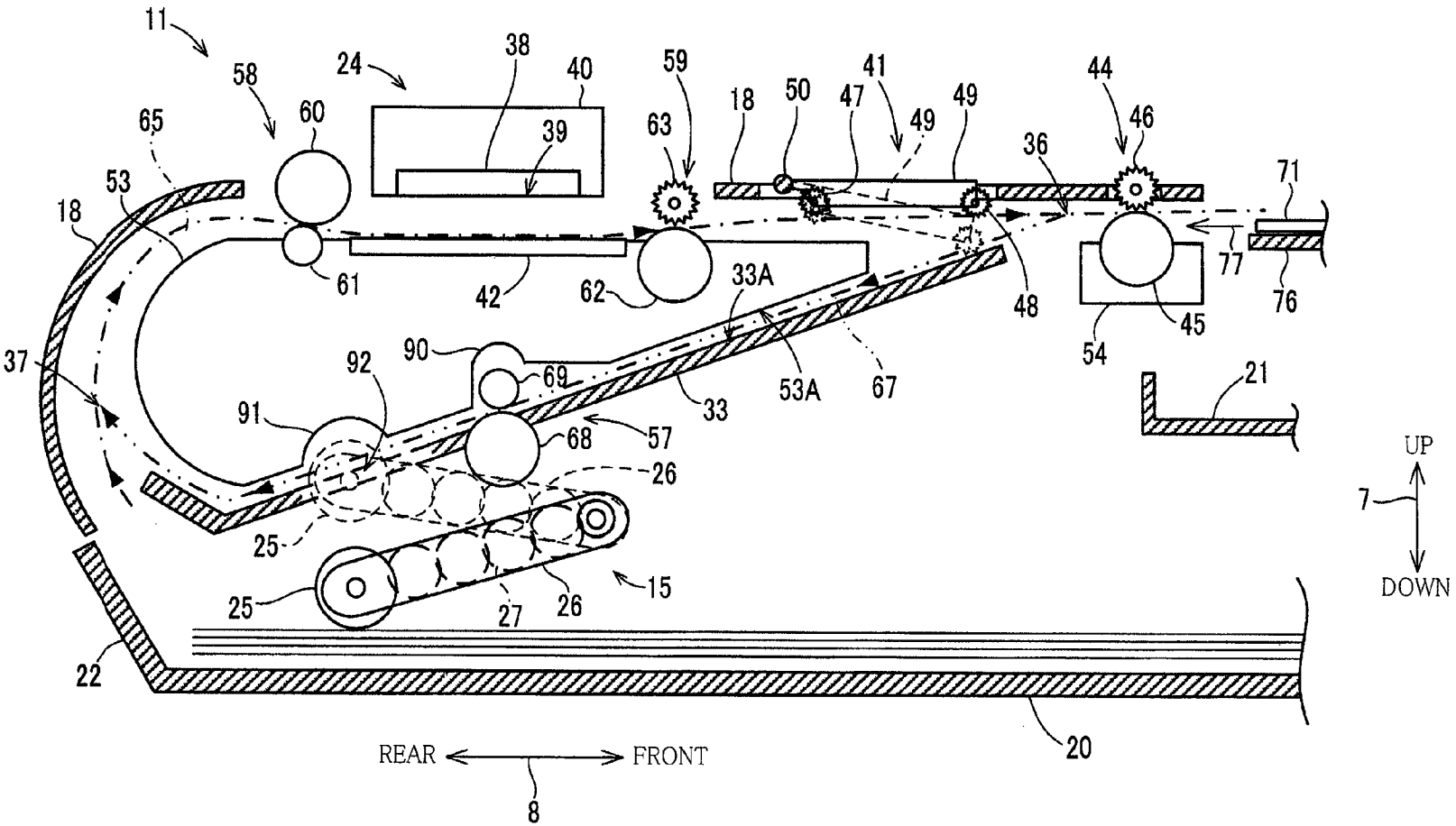
FIG. 2 is an elevational view in vertical cross section schematically showing an internal structure of a printing section 11.

As shown in FIG. 2, the printing section 11 includes a sheet-supply portion 15, a recording portion 24, and so on. The sheet-supply portion 15 supplies one of the recording sheets stacked on the sheet-supply tray 20. The recording portion 24 of an ink-jet recording type ejects ink droplets onto the supplied recording sheet to record an image on the recording sheet. It is noted that the recording portion 24 can record an image not only on the recording sheet but also on a storage medium as will be described below. The printing section 11 records an image on the recording sheet on the basis of recording data or the like received from an external device. Further, the MFD 10 has a function for recording an image by the recording portion 24 on a disc surface of a storage medium as a second recording medium having a larger thickness than that of the recording sheet, such as a CD-ROM and a DVD-ROM. This function will be explained later.

<First Convey Path 65>

On a rear side of the sheet-supply tray 20 mounted on the MFD 10, there is disposed an inclined sheet-separate plate 22 which extends in the rightward and leftward direction 9 (perpendicular to a sheet face of FIG. 2). The inclined sheet-separate plate 22 is provided at a rear end portion of the sheet-supply tray 20 so as to be inclined obliquely upward and rearward. Where a plurality of the recording sheets are supplied from the sheet-supply tray 20, the inclined sheet-separate plate 22 separates the recording sheets to guide an uppermost one of the sheets upward.

A first convey path 65 is defined above the inclined sheet-separate plate 22. The first convey path 65 curves upward from a position just above the inclined sheet-separate prate 22 and extends from the rear side to the front side. The first convey path 65 reaches the sheet-discharge tray 21 by passing through a nipping position of a third roller pair 58, a position below the recording portion 24, a nipping position of a fourth roller pair 59, and a nipping position of a second roller pair 44.

The recording sheet is fed through the first convey path 65 in a sheet feeding direction indicated by one-dot chain line arrow shown in FIG. 2. The first convey path 65 is defined by an outer guide member 18 and a first guide member 53 with a specific distance interposed therebetween. As will be described below, the first guide member 53 is movable in the upward and downward direction 7.

<Sheet-Supply Portion 15>

The sheet-supply portion 15 is provided on an upper side of the sheet-supply tray 20. The sheet-supply portion 15 includes a sheet-supply roller 25, a sheet-supply arm 26, and a drive-power transmitting mechanism 27. The sheet-supply roller 25 is supported by a free end of portion of the sheet-supply arm 26 pivotable in the upward and downward direction 7 so as to be moved toward and away from the sheet-supply tray 20. The sheet-supply arm 26 is pivoted between (a) a fifth posture thereof in which the sheet-supply roller 25 is held in contact with the sheet-supply tray 20 and (b) a sixth posture thereof in which the sheet-supply roller 25 is positioned near a second guide member 33 which will be described below. In FIG. 2, the fifth posture is indicated by solid lines, and the sixth posture is indicated by broken lines. The sheet-supply roller 25 is rotated by a drive power of a sheet-supply motor, not shown, which is transmitted by the drive-power transmitting mechanism 27 including a plurality of gears meshed with one another. The sheet-supply roller 25 supplies the recording sheets stacked on the sheet-supply tray 20 one by one to the first convey path 65.

<Recording Portion 24>

The recording portion 24 includes a recording head 38 and a carriage 40. The recording head 38 is mounted on the carriage 40 which is reciprocable in a main scanning direction (i.e., the direction perpendicular to the sheet face of FIG. 2). Ink is supplied from ink cartridges, not shown, to the recording head 38. The recording head 38 ejects fine ink droplets from nozzles 39. The carriage 40 is reciprocated in the main scanning direction, whereby the recording head 38 is accordingly reciprocated relative to the recording sheet. The recording head 38 ejects the ink while being reciprocated, to record an image on the recording sheet being fed on a platen 42 provided below the recording portion 24 so as to be opposed to the recording portion 24. The platen 42 supports a medium tray 71 which can support thereon the recording sheet and the storage medium. The medium tray 71 will be explained below. The platen 42 is supported by the first guide member 53. The first guide member 53 has an upper face on which the recording sheet and the medium tray 71 can be supported, that is, the upper face of the first guide member 53 functions as a support face of the first guide member 53 as a support member.

<Second Roller Pair 44, Third Roller Pair 58, Fourth Roller Pair 59>

The third roller pair 58 is provided on an upstream side of the recording portion 24 in the sheet feeding direction. The third roller pair 58 is constituted by a pair of rollers: a first convey roller 60 and a pinch roller 61. The pinch roller 61 is held in pressing contact with a roller face of the first convey roller 60 by an elastic member such as a spring, not shown. The third roller pair 58 nips and feeds or conveys the fed recording sheet onto the platen 42.

The fourth roller pair 59 is provided on a downstream side of the recording portion 24 in the sheet feeding direction. The fourth roller pair 59 is constituted by a pair of rollers: a second convey roller 62 and a spur roller 63. Like the pinch roller 61, the spur roller 63 is held in pressing contact with a roller face of the second convey roller 62 by an elastic member. The fourth roller pair 59 nips and feeds or conveys the recording sheet fed from the recording portion 24, toward the sheet-discharge tray 21 or toward a downstream side in the sheet feeding direction.

The second roller pair 44 constituted by a pair of rollers is provided on a downstream side of the fourth roller pair 59 in the sheet feeding direction. It is noted that where the image is recorded on the disc surface of the storage medium as will be described below, the medium tray 71 on which the storage medium has been placed is inserted from the opening 13 (see FIG. 1) along the first convey path 65 in a direction indicated by an arrow 77 (see FIG. 2). That is, the second roller pair 44 is provided on a side of the fourth roller pair 59 which is nearer to a position at which the medium tray 71 is inserted.

The pair of rollers of the second roller pair 44 are a spur roller 46 and a third convey roller 45. The third convey roller 45 is disposed below the spur roller 46 so as to be opposed to the spur roller 46. Like the pinch roller 61, the spur roller 46 is held in pressing contact with a roller face of the third convey roller 45 by an elastic member. The second roller pair 44 nips and feeds or conveys the recording sheet fed from the fourth roller pair 59, toward the sheet-discharge tray 21 or a second convey path 67 which will be explained below.

In the present embodiment, among the roller pairs 58, 59, 44, the first convey roller 60, the spur roller 63, and the spur roller 46 each located on an upper side of the first convey path 65 are rotatably supported by a frame, not shown, of the printing section 11, for example. The pinch roller 61 and the second convey roller 62 each located on a lower side of the first convey path 65 is rotatably supported by the first guide member 53 which will be explained below, and the third convey roller 45 is rotatably supported by a third guide member 54 movable in the upward and downward direction 7 which will be explained below.

The first convey roller 60, the second convey roller 62, and the third convey roller 45 are rotated by a drive power of a convey motor, not shown, which is transmitted via a drive-power transmitting mechanism, not shown. The drive-power transmitting mechanism is constituted by a planetary gear and other power transmitting components. Where the convey motor is rotated in one of forward and reverse directions (in a forward direction in the present embodiment), the rollers 60, 62, 45 are rotated such that the recording sheet or the medium tray 71 is conveyed in the sheet feeding direction. On the other hand, where the convey motor is rotated in the other of the forward and reverse directions (in a reverse direction in the present embodiment), the rollers 60, 62, 45 are rotated such that the recording sheet or the medium tray 71 is conveyed in a direction opposite to the sheet feeding direction. However, as will be described below, the third convey roller 45 does not convey the medium tray 71.

<Path Switch Portion 41>

A path switch portion 41 is provided on a downstream side of the fourth roller pair 59 in the sheet feeding direction and an upstream side of the second roller pair 44 in the sheet feeding direction. The path switch portion 41 is constituted by a support shaft 50, a flap 49, an auxiliary roller 47, and an auxiliary roller 48.

A branch opening 36 is defined on a downstream side of the path switch portion 41 in the sheet feeding direction and an upstream side of the second roller pair 44 in the sheet feeding direction. When images are respectively recorded on both sides of the recording sheet, the recording sheet fed through the first convey path 65 is switched back (or fed in the direction opposite to the sheet feeding direction) at a position located on a downstream side of the branch opening 36 in the sheet feeding direction. The recording sheet is then fed toward the second convey path 67 extending obliquely downward from the branch opening 36.

The support shaft 50 is provided on the outer guide member 18 partly constituting an upper guide face of the first convey path 65. The support shaft 50 extends in the direction perpendicular to the sheet face of FIG. 2, i.e., the rightward and leftward direction 9 in FIG. 1. The flap 49 is supported by the support shaft 50 so as to be pivotable about the support shaft 50. The flap 49 extends from the support shaft 50 toward the downstream side in the sheet feeding direction. That is, the path switch portion 41 is pivotable about one of opposite end portions thereof which is nearer to the recording portion 24. The auxiliary roller 47 and the auxiliary roller 48 each functioning as a spur roller are supported by their respective shafts provided in the flap 49.

The path switch portion 41 is configured such that a posture thereof is changeable. Specifically, the path switch portion 41 is pivotable between (a) a sheet-discharge posture in which a lower end of the auxiliary roller 48 is located above a height level of the branch opening 36 and (b) a reverse posture in which the lower end of the auxiliary roller 48 is located below the height level of the branch opening 36. In FIG. 2, the sheet-discharge posture is indicated by a solid line, and the reverse posture is indicated by a broken line.

The path switch portion 41 is normally in the reverse posture by its own weight. When a leading end of the recording sheet having passed through the position below the recording portion 24 has reached the path switch portion 41 being in the reverse posture, the path switch portion 41 is pressed by an upper face of the recording sheet, whereby the posture of the path switch portion 41 is changed from the reverse posture to the sheet-discharge posture. In this state, the recording sheet having passed through the path switch portion 41 is nipped by the second roller pair 44. Since the third convey roller 45 is forwardly rotated in a state in which the path switch portion 41 is in the sheet-discharge posture, the recording sheet is fed toward the sheet-discharge tray 21. Then, when a trailing end portion of the recording sheet has reached a prescribed position located on an upstream side of the auxiliary roller 48 in the sheet feeding direction, a force of the path switch portion 41 for pivoting toward the reverse posture by its own weight becomes greater than a force of the recording sheet for pressing up the path switch portion 41. Thus, the posture of the path switch portion 41 is changed from the sheet-discharge posture to the reverse posture. As a result, the trailing end portion of the recording sheet is pressed downward by the auxiliary roller 48 so as to be directed toward the second convey path 67.

In the case of one-side recording, since the third convey roller 45 is kept to be rotated forwardly, the second roller pair 44 discharges the recording sheet onto the sheet-discharge tray 21. On the other hand, in the case of two-side recording, the rotation of the third convey roller 45 is changed from the forward rotation to the reverse rotation in the state in which the trailing end portion of the recording sheet is directed toward the second convey path 67. As a result, the recording sheet is fed by the second roller pair 44 toward the second convey path 67, that is, the recording sheet is switched back.

<Second Convey Path 67>

The second convey path 67 is branched from the first convey path 65 at the branch opening 36 and extends so as to pass through a position below the first guide member 53 and above the sheet-supply portion 15 and then merge with the first convey path 65 at a meeting point 37 located on an upstream side of the recording portion 24 in the sheet feeding direction. The recording sheet is fed through the second convey path 67 from the branch opening 36 to the meeting point 37.

The second convey path 67 is defined by the first guide member 53 provided above the second convey path 67 and the second guide member 33 provided below the second convey path 67. The first guide member 53 has a lower face as an inclined face 53A inclined obliquely downward and rearward from the branch opening 36. The second guide member 33 is mounted, e.g., on the frame of the printing section 11 and has an upper face as an inclined face 33A inclined obliquely downward and rearward from the branch opening 36.

A first roller pair 57 is provided in the second convey path 67. The first roller pair 57 is constituted by a fourth convey roller 68 and a pinch roller 69. The pinch roller 69 is held in pressing contact with a roller face of the fourth convey roller 68 by its own weight or a spring, for example. The fourth convey roller 68 is rotated by a drive power from the convey motor to feed or convey the recording sheet from the branch opening 36 to the meeting point 37. It is noted that the fourth convey roller 68 is positioned in the rightward and leftward direction 9 so as not to contact with the sheet-supply portion 15 being in the sixth posture.

<Medium Tray 71>

As described above, the MFD 10 has the function for recording the image on the disc surface of the storage medium such as a CD-ROM and a DVD-ROM. Where the image is recorded on the disc surface of the storage medium, the storage medium is placed or mounted on the medium tray 71. As will be described below, the medium tray 71 is, while being mounted or supported on a tray guide 76, inserted from the opening 13 along the first convey path 65 in the direction indicated by the arrow 77 which is opposite to the sheet feeding direction. It is noted that the MFD 10 may be configured such that the storage medium is independently inserted from the opening 13 in a state in which the storage medium is not placed on the medium tray 71.

Figure 3:
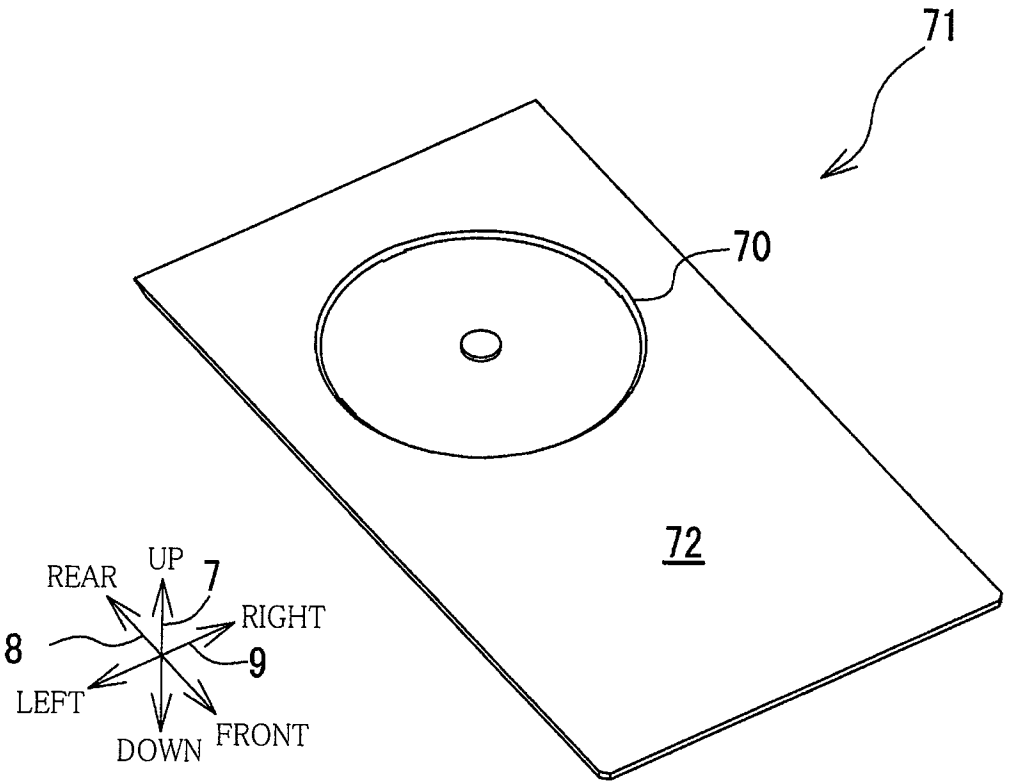
FIG. 3 is a perspective view showing a medium tray 71.

As shown in FIG. 3, the medium tray 71 is formed of a resin and has a thickness of a few millimeters (e.g., 2 to 3 mm) in the upward and downward direction 7. Each of a length of the medium tray 71 in its conveying direction (i.e., in the frontward and rearward direction 8) and a length thereof in its widthwise direction (i.e., in the rightward and leftward direction 9) is longer than the thickness thereof in the upward and downward direction 7. The length of the medium tray 71 in the conveying direction is longer than the length thereof in the widthwise direction. That is, the medium tray 71 is a resin plate of a slim type having a rectangular parallelepiped shape. An upper face 72 of the medium tray 71 has a circular recess formed therein so as to provide a medium placed portion 70 on which the storage medium is placed or mounted. It is noted that an object placed on the medium tray 71 is not limited to the storage medium. For example, the recording sheet may be placed on the medium tray 71.

<First Guide Member 53>

Figure 4:
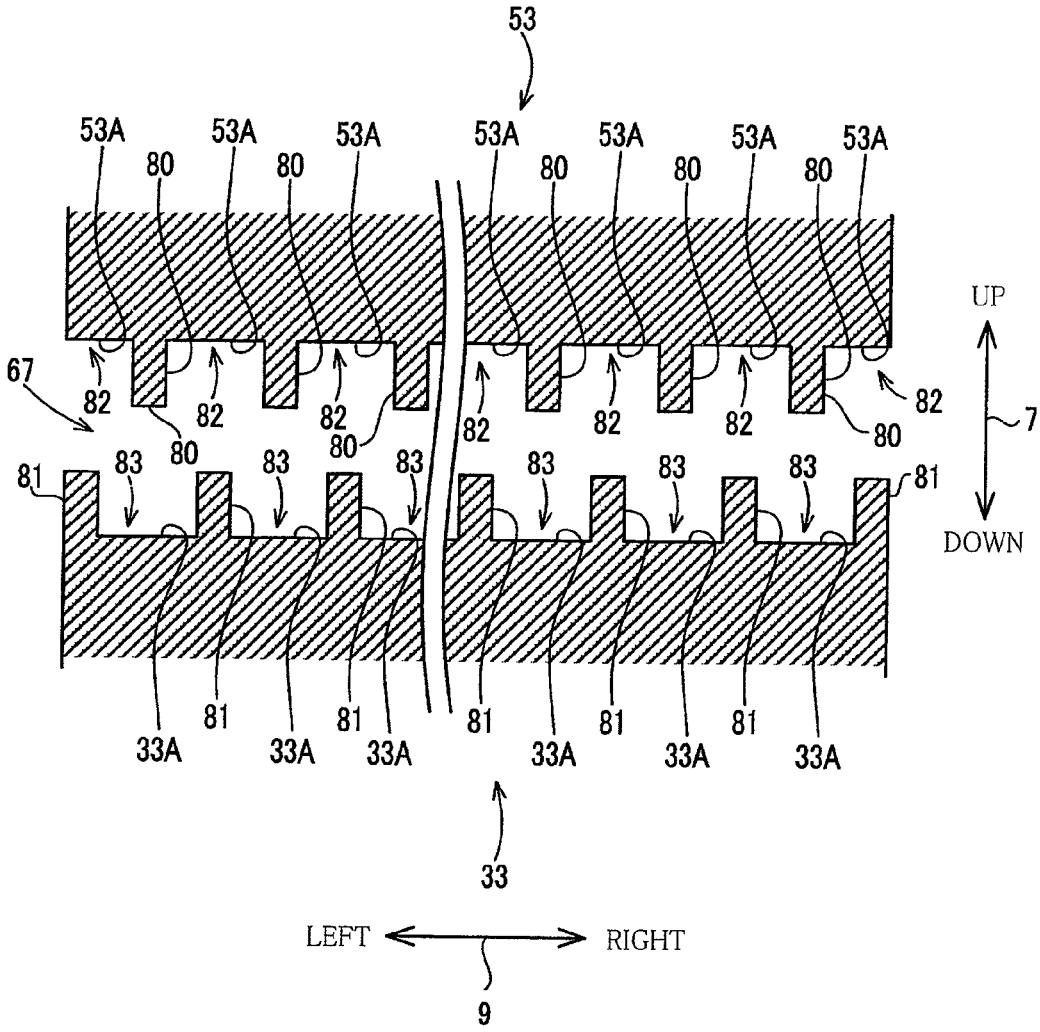
FIG. 4 is an elevational view in vertical cross section schematically showing a second convey path 67.

As shown in FIG. 4, a plurality of first ribs 80 are provided on the inclined face 53A of the first guide member 53. The first ribs 80 are provided along the second convey path 67 with predetermined pitches in the rightward and leftward direction 9 (i.e., a direction perpendicular in a horizontal plane to the sheet feeding direction in which the recording sheet is fed through the first convey path 65). Each of the first ribs 80 stands toward the inclined face 33A of the second guide member 33 in a direction perpendicular to the rightward and leftward direction 9 and perpendicular to a direction in which the second convey path 67 extends. When the recording sheet is fed through the second convey path 67, the upper face of the recording sheet contacts not with the inclined face 53A but with the first ribs 80. That is, distal end portions (lower end portions) of the respective first ribs 80 arranged in the rightward and leftward direction 9 function as the upper guide face of the second convey path 67. It is noted that the inclined face 53A is formed on the first guide member 53, and thus the inclined face 53A and the first guide member 53 can be considered to be constructed integrally with each other.

As shown in FIG. 2, a first recessed portion 90 as a first accommodating portion having a shape corresponding to the pinch roller 69 is formed in the inclined face 53A of the first guide member 53 at a position above the pinch roller 69 and opposed to the pinch roller 69. The first recessed portion 90 is formed by a recess slightly larger than the pinch roller 69 so as to accommodate or hold therein the pinch roller 69.

A second recessed portion 91 as a second accommodating portion is formed in the inclined face 53A of the first guide member 53 at a position located on a rear side of the first recessed portion 90. The second recessed portion 91 is formed by a recess slightly larger than the sheet-supply roller 25 so as to accommodate or hold therein at least a part of the sheet-supply roller 25 being in the sixth posture. It is noted that, as will be described below, when the posture of the sheet-supply roller 25 is changed from the fifth posture to the sixth posture, the sheet-supply roller 25 is moved through an opening 92 formed in the second guide member 33.

<Second Guide Member 33>

As shown in FIG. 4, a plurality of second ribs 81 are provided on the inclined face 33A of the second guide member 33. The second ribs 81 are provided along the second convey path 67 with predetermined pitches in the rightward and leftward direction 9 (i.e., the direction perpendicular in a horizontal plane to the sheet feeding direction in which the recording sheet is fed through the first convey path 65). Each of the second ribs 81 stands toward the inclined face 53A of the first guide member 53 in a direction perpendicular to the rightward and leftward direction 9 and perpendicular to a direction in which the second convey path 67 extends. Here, each second rib 81 is provided so as to face a position between corresponding two of the first ribs 80 provided on the inclined face 53A. In other words, each second rib 81 is provided so as to face a corresponding one of non-provided positions 82 on the inclined face 53A in each of which no first ribs 80 are provided. When the recording sheet is fed through the second convey path 67, a lower face of the recording sheet contacts not with the inclined face 33A but with the second ribs 81. That is, distal end portions (upper end portions) of the respective second ribs 81 arranged in the rightward and leftward direction 9 function as a lower guide face of the second convey path 67.

As described above, the second ribs 81 are provided along the second convey path 67 with the predetermined pitches in the rightward and leftward direction 9. Further, each first rib 80 is provided so as to face a position between corresponding two of the second ribs 81 provided on the inclined face 33A. In other words, each first rib 80 is provided so as to face a corresponding one of non-provided positions 83 on the inclined face 33A in each of which no second ribs 81 are provided. In view of the above, the first ribs 80 are arranged at positions different, in a direction perpendicular to a direction in which the recording sheet is fed through the second convey path 67, from positions at which the second ribs 81 are arranged. Further, the opening 92 is formed in the inclined face 33A of the second guide member 33 at a position at which the sheet-supply roller 25 being in the sixth posture is located.

<Driving Mechanism 95>

Figure 5:
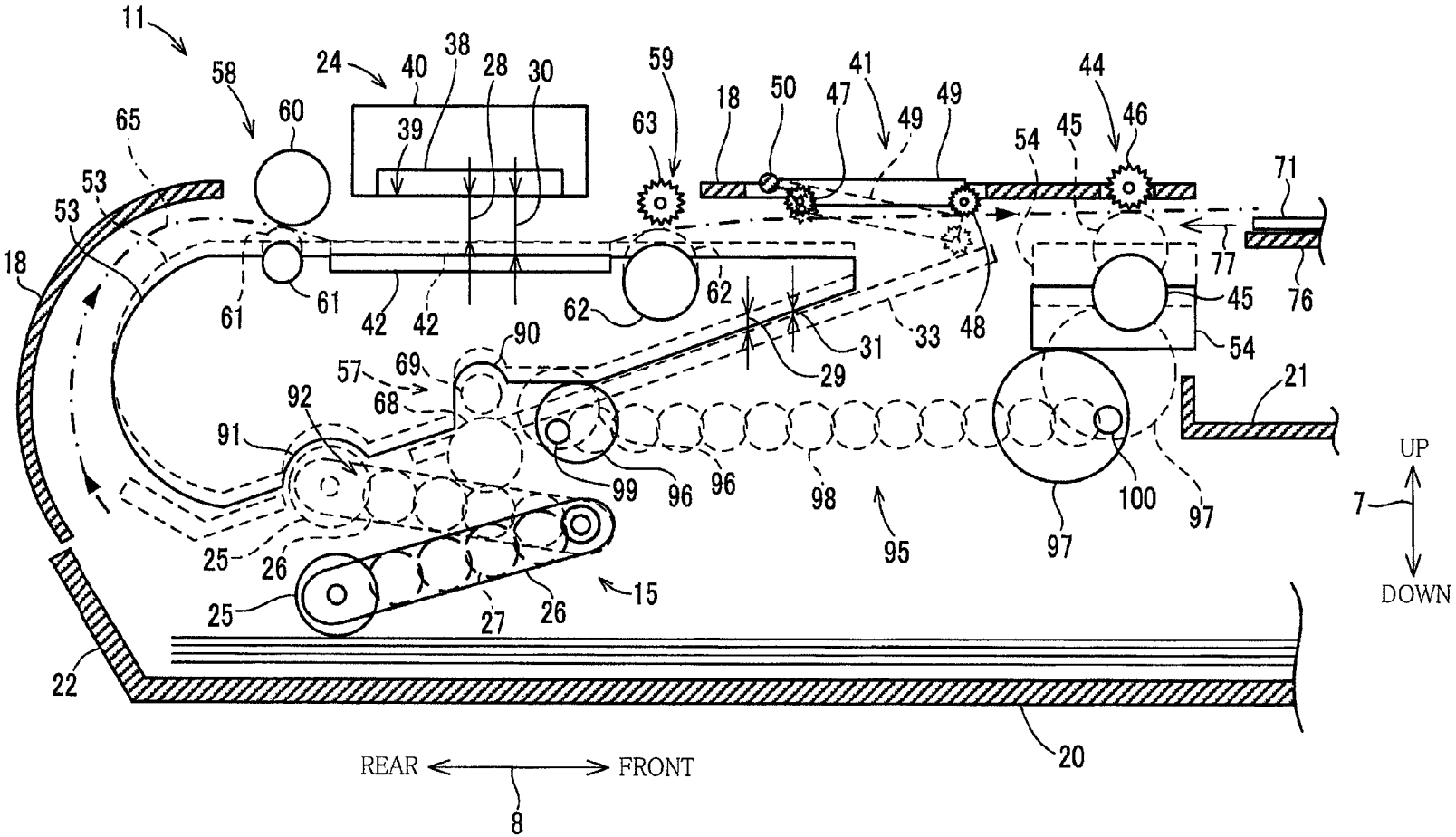
FIG. 5 is an elevational view in vertical cross section schematically showing an internal structure of the printing section 11 in a state in which a first guide member 53 and a third guide member 54 have been moved downward.

As shown in FIG. 5, a driving mechanism 95 as a posture change mechanism is provided in the printing section 11. The driving mechanism 95 is configured to change a posture of the first guide member 53 such that the posture of the first guide member 53 is interlocked or synchronized with a change of a posture of the second roller pair 44. In order to perform this operation, the driving mechanism 95 in the present embodiment includes a first eccentric cam 96, the third guide member 54, a second eccentric cam 97 as a roller moving mechanism, and a connecting member 98 as an interlock mechanism. The first eccentric cam 96 changes the posture of the first guide member 53. The third guide member 54 and the second eccentric cam 97 change the posture of the second roller pair 44. The connecting member 98 interlocks the change of the posture of the second roller pair 44 and the change of the posture of the first guide member 53. It is noted that the following explanation of the driving mechanism 95 is merely an example, and accordingly the driving mechanism 95 may have any configuration as long as the above-described operation can be performed.

The first guide member 53 is movable in the upward and downward direction 7 to change its posture between a first posture indicated by a broken line in FIG. 5 and a second posture indicated by a solid line in FIG. 5. Further, since the platen 42, the pinch roller 61, and the second convey roller 62 supported by the first guide member 53 are movable in the upward and downward direction 7 together with the first guide member 53, respective postures of the same 42, 61, 62 are also changed between their respective first postures and second postures.

Where the first guide member 53 is in the first posture, a height (distance) of the first convey path 65 in the upward and downward direction 7 becomes a first height 28 which allows the recording sheet to be fed or conveyed through the first convey path 65, and a height of the second convey path 67 in the upward and downward direction 7 becomes a second height 29 which allows the recording sheet to be fed or conveyed through the second convey path 67.

On the other hand, where the first guide member 53 is in the second posture, the height of the first convey path 65 in the upward and downward direction 7 becomes a third height 30 which is greater than the first height 28 and which allows the medium tray 71 (or the storage medium where the storage medium is directly inserted) to be conveyed through the first convey path 65, and the height of the second convey path 67 in the upward and downward direction 7 becomes a fourth height 31 smaller than the second height 29.

It is noted that, as shown in FIG. 5, the first height 28 is a distance between (a) a position (as an upper end of the first height 28) on a lower face of the recording portion 24 in which the nozzle 39 are formed and (b) a position (as a lower end of the first height 28) on an upper face of the platen 42 in the state in which the first guide member 53 is in the first posture. Further, the third height 30 is a distance between (a) a position (as an upper end of the third height 30) on the lower face of the recording portion 24 and (b) a position (as a lower end of the third height 30) on the upper face of the platen 42 in the state in which the first guide member 53 is in the second posture. Further, the second height 29 is a distance between (a) a position (as an upper end of the second height 29) on the inclined face 53A in the state in which the first guide member 53 is in the first posture and (b) a position (as a lower end of the second height 29) on the inclined face 33A of the second guide member 33. Further, the fourth height 31 is a distance between (a) a position (as an upper end of the fourth height 31) on the inclined face 53A in the state in which the first guide member 53 is in the second posture and (b) a position (as a lower end of the fourth height 31) on the inclined face 33A of the second guide member 33. It is noted that, in the present embodiment, since the plurality of the first ribs 80 are provided on the inclined face 53A, and the plurality of the second ribs 81 are provided on the inclined face 33A, the upper end of the second height 29 is constituted by the distal end portions of the respective first ribs 80 in the state in which the first guide member 53 is in the first posture, and the lower end of the second height 29 is constituted by the distal end portions of the respective second ribs 81. Further, the upper end of the fourth height 31 is constituted by the distal end portions of the respective first ribs 80 in the state in which the first guide member 53 is in the second posture, and the lower end of the fourth height 31 is constituted by the distal end portions of the respective second ribs 81.

It is noted that a state in which the recording sheet can be fed through the first convey path 65 having the first height 28 means that the recording sheet can pass through between (a) the outer guide member 18 and the recording portion 24 and (b) the first guide member 53 and the platen 42, and a distance between the recording portion 24 and the recording sheet located just below the recording portion 24 is a distance in which the image recording by the recording portion 24 can be normally performed. Further, a state in which the medium tray 71 can be conveyed through the first convey path 65 having the third height 30 means that the medium tray 71 can pass through between (a) the outer guide member 18 and the recording portion 24 and (b) the first guide member 53 and the platen 42, and a distance between the recording portion 24 and the medium tray 71 located just below the recording portion 24 is a distance in which the image recording by the recording portion 24 can be normally performed.

It is noted that where the first guide member 53 is in the second posture, the pinch roller 69 is accommodated in the first recessed portion 90.

Where the first guide member 53 is in the first posture, the first convey roller 60 and the pinch roller 61 constituting the third roller pair 58 contact with each other, and the second convey roller 62 and the spur roller 63 constituting the fourth roller pair 59 also contact with each other. Thus, the third roller pair 58 and the fourth roller pair 59 can nip the recording sheet. On the other hand, where the first guide member 53 is in the second posture, each of (a) a distance between the first convey roller 60 and the pinch roller 61 constituting the third roller pair 58 and (b) a distance between the second convey roller 62 and the spur roller 63 constituting the fourth roller pair 59 becomes a distance suitable for nipping the medium tray 71. Thus, the medium tray 71 can be conveyed through the first convey path 65. That is, when the posture of the first guide member 53 is changed from the first posture to the second posture, the pinch roller 61 and the second convey roller 62 is moved downward by a thickness of the medium tray 71.

In the present embodiment, the first guide member 53 is moved in the upward and downward direction 7 by the first eccentric cam 96 provided on the lower side of the first guide member 53 so as to contact with the first guide member 53. The first eccentric cam 96 is supported, e.g., by the frame of the printing section 11 so as to be rotatable about a first shaft 99 extending in the rightward and leftward direction 9. The first eccentric cam 96 is a circular disc in which the position of the first shaft 99 is displaced from a center of the first eccentric cam 96, and accordingly distances between the first shaft 99 and circumferential positions of a circumferential face of the first eccentric cam 96 vary. The first guide member 53 is supported by the first eccentric cam 96 so as to be placed or mounted on the same 96. The first eccentric cam 96 and the first guide member 53 contact with each other at opposite end portions of the first guide member 53 in the rightward and leftward direction 9, which opposite end portions are located on an outside of respective opposite ends of the second guide member 33 in the rightward and leftward direction 9. That is, the first eccentric cam 96 is disposed so as not to contact with the second guide member 33.

In the present embodiment, as will be described below, the first eccentric cam 96 is rotated by obtaining a rotational force of the second eccentric cam 97 via the connecting member 98. When the first eccentric cam 96 is rotated, the circumferential face of the first eccentric cam 96 is slid relative to the first guide member 53. The distances between the first shaft 99 and the circumferential positions of the circumferential face of the first eccentric cam 96 vary, and accordingly the first guide member 53 is moved in the upward and downward direction 7. Where the distance between the first shaft 99 and the circumferential face of the first eccentric cam 96 is the largest, the first guide member 53 is in the first posture. Where the first eccentric cam 96 is rotated and the distance between the first shaft 99 and the circumferential face of the first eccentric cam 96 is the shortest, the first guide member 53 is in the second posture.

<Second Eccentric Cam 97 and Connecting Member 98>

The posture of the second roller pair 44 is changeable between (a) a third posture in which the spur roller 46 and the third convey roller 45 constituting the second roller pair 44 contact with each other and (b) a fourth posture in which the spur roller 46 and the third convey roller 45 are distant from each other. Where the second roller pair 44 is in the third posture, the spur roller 46 and the third convey roller 45 can nip the recording sheet to feed the recording sheet through the first convey path 65. On the other hand, where the second roller pair 44 is in the fourth posture, a distance between the third convey roller 45 and the spur roller 46 becomes greater than the thickness of the medium tray 71. That is, an amount of a change of the distance between the third convey roller 45 and the spur roller 46 where the posture of the second roller pair 44 is changed from the third posture to the fourth posture is larger than an amount of the change of each of the distance between the first convey roller 60 and the pinch roller 61 constituting the third roller pair 58 and the distance between the second convey roller 62 and the spur roller 63 constituting the fourth roller pair 59 where the posture of the first guide member 53 is changed from the first posture to the second posture. As a result, in the present embodiment, the second roller pair 44 being in the fourth posture does not nip the medium tray 71.

In the present embodiment, the third convey roller 45 which is a lower roller of the second roller pair 44 is moved in the upward and downward direction 7, whereby the posture of the second roller pair 44 is changed. That is, the third convey roller 45 is movable such that where the second roller pair 44 is in the third posture, the third convey roller 45 is positioned at a first position (indicated by a broken line in FIG. 5) at which the third convey roller 45 contacts with the spur roller 46, and where the second roller pair 44 is in the fourth posture, the third convey roller 45 is positioned at a second position (indicated by a solid line in FIG. 5) which is located on a lower side of the first position and at which the third convey roller 45 is distant from the spur roller 46.

In the present embodiment, the third convey roller 45 is moved in the upward and downward direction 7 by (a) the third guide member 54 configured to support the third convey roller 45 and (b) the second eccentric cam 97 provided on the lower side of the third guide member 54 so as to contact with the third guide member 54. Like the first eccentric cam 96, the second eccentric cam 97 is supported, e.g., by the frame of the printing section 11 so as to be rotatable about a second shaft 100 extending in the rightward and leftward direction 9. The second eccentric cam 97 is a circular disc in which the position of the second shaft 100 is displaced from a center of the second eccentric cam 97, and accordingly distances between the second shaft 100 and circumferential positions of a circumferential face of the second eccentric cam 97 vary. The third guide member 54 is supported by the second eccentric cam 97 so as to be placed or mounted on the same 97.

It is noted that diameters of the first and second eccentric cams 96, 97 and the positions of the first and second shafts 99, 100 are adjusted such that an amount of the change of the position of the third convey roller 45 from the first position to the second position is larger than an amount of the change of the posture of the first guide member 53 from the first posture to the second posture. In the present embodiment, the diameter of the second eccentric cam 97 is greater than that of the first eccentric cam 96.

The second eccentric cam 97 is rotated by a drive power transmitted from a cum motor, not shown. When the second eccentric cam 97 is rotated, the circumferential face of the second eccentric cam 97 is slid relative to the third guide member 54. The distances between the second shaft 100 and the circumferential positions of the circumferential face of the second eccentric cam 97 vary, and accordingly the third guide member 54 is moved in the upward and downward direction 7. The third convey roller 45 is moved in the upward and downward direction 7 by the movement of the third guide member 54 in the upward and downward direction 7. Where the distance between the second shaft 100 and the circumferential face of the second eccentric cam 97 is the largest, the second roller pair 44 is in the third posture. Where the second eccentric cam 97 is rotated and the distance between the second shaft 100 and the circumferential face of the second eccentric cam 97 is the shortest, the second roller pair 44 is in the fourth posture.

The connecting member 98 is constituted by a plurality of gears arranged generally in a straight line. One of opposite ends of the gears is meshed with the first shaft 99, and the other of the opposite ends is meshed with the second shaft 100. Where the connecting member 98 is configured in this manner, when the second eccentric cam 97 is rotated, a rotational force of the second eccentric cam 97 is transmitted to the first eccentric cam 96 by the connecting member 98, whereby the first eccentric cam 96 is rotated.

That is, the third convey roller 45 is moved between the first position and the second position by the third guide member 54 and the second eccentric cam 97. Further, the connecting member 98 is interlocked or synchronized with the movement of the third convey roller 45 from the first position to the second position to integrally change the posture of the platen 42 and the first guide member 53 from the first posture to the second posture. In other words, when the second roller pair 44 is in the third posture, the driving mechanism 95 integrally changes the posture of the platen 42 and the first guide member 53 to the first posture, and when the second roller pair 44 is in the fourth posture, the driving mechanism 95 integrally changes the posture of the platen 42 and the first guide member 53 to the second posture.

<Image Recording on Storage Medium>

There will be next explained a procedure in a case where the medium tray 71 is inserted into the MFD 10, and the image is recorded on the storage medium placed on the medium tray 71.

When a controller, not shown, has outputted a command for recording the image on the storage medium, the second eccentric cam 97 is rotated, whereby the third guide member 54 is moved downward. As a result, the third convey roller 45 is moved from the first position to the second position. Further, the first eccentric cam 96 is rotated by being interlocked with the rotation of the second eccentric cam 97. As a result, the posture of the first guide member 53, the platen 42, and the pinch roller 61 and the second convey roller 62 is changed from the first posture to the second posture in an integrated manner.

Then, as shown in FIGS. 1 and 5, the medium tray 71 is inserted by a user from the opening 13 (formed in the front side of the MFD 10) along the first convey path 65 in the direction indicated by the arrow 77 which is opposite to the sheet feeding direction. In this time, the medium tray 71 is inserted in a state in which the medium tray 71 is placed or mounted on the tray guide 76. Where a sensor, not shown, has detected the insertion of the medium tray 71, the first convey roller 60 and the second convey roller 62 are driven so as to be rotated reversely.

Further, the posture of the path switch portion 41 is changed from the reverse posture to the sheet-discharge posture. This change of the posture is performed by the drive power which is transmitted from a motor, etc., to the path switch portion 41 on the basis of the image recording command for the storage medium as a trigger, for example. Alternately, this MFD 10 may be configured such that projections, not shown, are provided on a placed face (i.e., an upper face) of the tray guide 76 on which the medium tray 71 is placed, and a pressing onto the projections rotates the support shaft 50 of the path switch portion 41. Where the MFD 10 is configured in this manner, when the medium tray 71 is placed on the tray guide 76, the projections are pressed, thereby rotating the support shaft 50 to change the posture of the path switch portion 41.

When the medium tray 71 inserted by the user is nipped by the fourth roller pair 59, the medium tray 71 is disengaged from user's hand. The medium tray 71 is then conveyed by the fourth roller pair 59 in the direction opposite to the sheet feeding direction. The medium tray 71 then passes through the position below the recording portion 24 and is brought into contact with the third roller pair 58 from the downstream side in the sheet feeding direction. The medium tray 71 nipped by the third roller pair 58 and the fourth roller pair 59 is guided further toward the upstream side in the sheet feeding direction.

As a result, the storage medium placed on the medium tray 71 is positioned on an upstream side of the recording portion 24 in the sheet feeding direction. Then, the rotational direction of the first convey roller 60 and the second convey roller 62 is changed from the reverse direction to the forward direction. As a result, the medium tray 71 is conveyed in the sheet feeding direction and then the storage medium placed on the medium tray 71 passes through the platen 42. The recording head 38 ejects the ink droplets onto the storage medium being conveyed on the platen 42. As a result, the image is recorded on the disc surface of the storage medium. After this image recording, the medium tray 71 is discharged or ejected.

<Effects of Embodiment>

Where the image is recorded on the storage medium placed on the medium tray 71, each of the platen 42 and the first guide member 53 takes the second posture in which the medium tray 71 can be conveyed through the first convey path 65. As shown in FIG. 5, in this posture, the height of the second convey path 67 in the upward and downward direction 7 is the fourth height 31 smaller than the second height 29. That is, the first guide member 53 being in the second posture is located at a space having constituted the second convey path 67 having the second height 29. As a result, a space for the first guide member 53 taking the second posture is shared with the space constituting the second convey path 67. That is, there is no need that the space for the first guide member 53 taking the second posture is additionally formed or provided in the MFD 10. As a result, it is possible to make or keep a height of the MFD 10 relatively low.

In this MFD 10, the first ribs 80 constitute the guide face of the first guide member 53, and the second ribs 81 constitute the guide face of the second guide member 33, whereby an area in which the recording sheet contacts with the guide face defining the second convey path 67 is made smaller. As a result, the recording sheet can be smoothly fed through the second convey path 67. However, if the first ribs 80 and the second ribs 81 are provided so as to face each other, an area or a space in which the first guide member 53 is movable downward to take the second posture is limited to an area or space in which the lower ends of the respective first ribs 80 do not contact with the upper ends of the respective second ribs 81.

In the above-described embodiment, as shown in FIG. 4, the first ribs 80 and the second ribs 81 are disposed such that positions at which the first ribs 80 are disposed and positions at which the second ribs 81 are disposed are different from one another or do not overlap with each other in the rightward and leftward direction 9. Thus, the first guide member 53 is movable to an area or a space in which the lower ends of the respective first ribs 80 are located on a lower side of the upper ends of the respective second ribs 81. That is, it is possible to enlarge an area or a space shared by the space for the first guide member 53 taking the second posture and the space constituting the second convey path 67. As a result, it is possible to make the height of the MFD 10 relatively low.

In the above-described embodiment, when each of the platen 42 and the first guide member 53 is in the second posture, the pinch roller 69 can be retracted into the first recessed portion 90. As a result, each of the platen 42 and the first guide member 53 can take the second posture at a lower position. That is, it is possible to enlarge the space shared by the space for the first guide member 53 taking the second posture and the space constituting the second convey path 67. As a result, it is possible to make the height of the MFD 10 relatively low.

Where the image is recorded on the storage medium placed on the medium tray 71, each of the platen 42 and the first guide member 53 needs to take the second posture, and the third convey roller 45 and the spur roller 46 need to be distant from each other. In the above-described embodiment, as shown in FIG. 5, the first eccentric cam 96 is rotated so as to be interlocked or synchronized with the rotation of the second eccentric cam 97. Thus, when the posture of the second roller pair 44 supported by the second eccentric cam 97 is changed to the fourth posture, the posture of the first guide member 53 supported by the first eccentric cam 96 is changed to the second posture. Specifically, each of the platen 42 and the first guide member 53 takes the second posture when the third convey roller 45 is moved to the second position. Thus, the change of the posture of the second roller pair 44, which change is required for the image recording on the storage medium on the medium tray 71 can be performed without need to drive the second roller pair 44 independently of the platen 42 and the first guide member 53.

In order to make the MFD 10 lower in height, the second guide member 33 is preferably provided at a low position. However, where the MFD 10 includes the pivotable sheet-supply arm 26 as in the above-described embodiment, the sheet-supply roller 25 may be brought into contact with the lower face of the second guide member 33 when the sheet-supply arm 26 is pivoted upward. However, in the above-described embodiment, the second guide member 33 has the opening 92. Thus, where the sheet-supply arm 26 is pivoted upward in the configuration in which the second guide member 33 is disposed at the low position, the sheet-supply roller 25 is moved through the opening 92, which does not interfere with the pivotal movement of the sheet-supply arm 26. Further, in the above-described embodiment, the first guide member 53 has the second recessed portion 91. Thus, where the sheet-supply arm 26 is pivoted upward in a configuration in which the first guide member 53 takes the second posture at a low position, the sheet-supply roller 25 is accommodated in the second recessed portion 91, which does not interfere with the pivotal movement of the sheet-supply arm 26.

It is noted that, in the above-described embodiment, the inclined face 53A is formed on the first guide member 53, but this MFD 10 may be configured such that the first guide member 53 and the inclined face 53A are provided independently of each other and fixed to each other so as to be integrated, as long as the first guide member 53 and the inclined face 53A integrally change their respective postures.

<Modification of Embodiment>

In the above-described embodiment, the first guide member 53 and the third guide member 54 movable in the upward and downward direction 7 are provided in the printing section 11 such that the first guide member 53 supports the platen 42 and the rollers 61, 62, and the third guide member 54 supports the third convey roller 45. However, a configuration of the guide members (such as the number of the guide members and the positions thereof) is not limited to that in the above-described embodiment.

Figure 6:
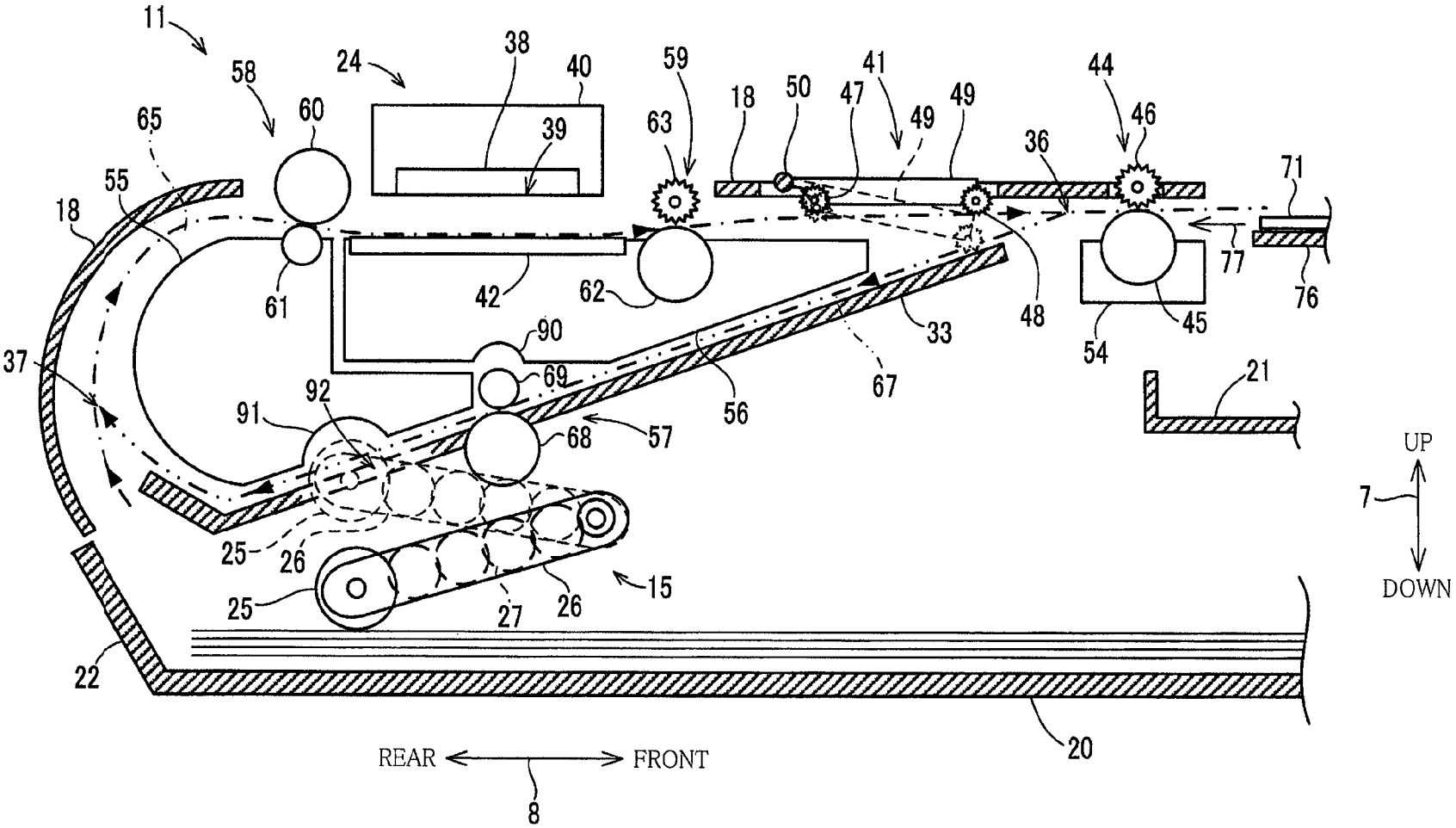
FIG. 6 is an elevational view in vertical cross section schematically showing an internal structure of the printing section 11 including a fourth guide member 55 and a fifth guide member 56.

For example, as shown in FIG. 6, two guide members such as a fourth guide member 55 and a fifth guide member 56 may be used instead of the first guide member 53 in the above-described embodiment. The fourth guide member 55 is disposed on an upstream side of the recording portion 24 in the sheet feeding direction in the first convey path 65. The fourth guide member 55 supports the pinch roller 61. The fifth guide member 56 is disposed on a downstream side of the fourth guide member 55 in the sheet feeding direction in the first convey path 65. The fifth guide member 56 supports the platen 42 and the second convey roller 62.

Driving mechanism and components, not shown, such as an eccentric cam for moving each of the fourth and fifth guide members 55, 56 are provided for each of the fourth and fifth guide members 55, 56.

The fourth and fifth guide members 55, 56 do not need to be moved at the same time. For example, this MFD 10 may be configured such that when a sensor, not shown, has detected the insertion of the medium tray 71 from the opening 13, the fifth guide member 56 is moved downward, and then when another sensor, not shown, has detected that the medium tray 71 has reached at the position just below the recording portion 24, the fourth guide member 55 is moved downward. Further, one of the fourth and fifth guide members 55, 56 (e.g., only the fifth guide member 56) may be movable downward.

In the above-described embodiment, the first eccentric cam 96 and the second eccentric cam 97 are used to increase the height of the first convey path 65, but the present invention is not limited to this configuration. That is, another mechanism not having a cam mechanism may be used as the driving mechanism 95. For example, this MFD 10 may be configured such that a frame supporting the platen 42 and the rollers is connected to the tray guide 76, and when the tray guide 76 is moved, the frame is accordingly moved to release the platen 42 and the rollers, causing the platen 42 and the rollers to move downward by their own weights to increase the height of the first convey path 65.

What is claimed is:

1. An image recording apparatus comprising:

a first convey path defined so as to guide a first recording medium, a second recording medium having a larger thickness than that of the first recording medium, and a tray designed to hold one of the first recording medium and the second recording medium;

a recording portion disposed above the first convey path and configured to record an image on the first recording medium and the second recording medium;

a support member disposed below the first convey path so as to be opposed to the recording portion, the support member being configured to support the first recording medium, the second recording medium, and the tray;

a second convey path connected to the first convey path and extending on a lower side of the support member so as to guide the first recording medium;

a first guide member having a guide face located on an upper side of the second convey path so as to partly define the second convey path;

a second guide member having a guide face located on a lower side of the second convey path so as to partly define the second convey path; and a posture change mechanism configured to integrally change a posture of the support member and the first guide member between (a) a first posture in which a height of the first convey path in an upward and downward direction is a first height which allows the first recording medium to pass through the first convey path, and a height of the second convey path in the upward and downward direction is a second height which allows the first recording medium to pass through the second convey path and (b) a second posture in which the height of the first convey path in the upward and downward direction is a third height which is larger than the first height and allows the second recording medium or the tray to pass through the first convey path, and the height of the second convey path in the upward and downward direction is a fourth height smaller than the second height.

2. The image recording apparatus according to claim 1, wherein the first guide member is constituted by two members independent of each other in a direction along the second convey path, and wherein the posture change mechanism is configured to integrally change a posture of the support member and at least one of the two members.

3. The image recording apparatus according to claim 1, wherein each of the first height and the third height is a distance of the first convey path in the upward and downward direction and defined by a lower face of the recording portion and an upper face of the support member.

4. The image recording apparatus according to claim 1, wherein each of the second height and the fourth height is a distance of the second convey path in the upward and downward direction and defined by the guide face of the first guide member and the guide face of the second guide member.

5. The image recording apparatus according to claim 1, wherein the first guide member is formed on a portion of the support member, which portion is different from another portion of the support member on which the first recording medium, the second recording medium, and the tray are supported.

6. The image recording apparatus according to claim 1, wherein the first guide member includes a plurality of first rib portions projecting toward the second guide member and extending in a convey direction in which the first recording medium is conveyed through the second convey path, distal end portions of the respective first rib portions constituting the guide face of the first guide member, wherein the second guide member includes a plurality of second rib portions projecting toward the first guide member and extending in the convey direction, distal end portions of the respective second rib portions constituting the guide face of the second guide member, wherein each of the second rib portions is arranged at a position different, in a direction perpendicular to the convey direction and along a horizontal plane, from a position at which each of the first rib portions is arranged, and wherein the first rib portions and the second rib portions are alternatively arranged one by one in the direction perpendicular to the convey direction and along the horizontal plane.

7. The image recording apparatus according to claim 1, further comprising a first roller pair constituted by a pair of rollers and provided on the second convey path so as to nip and convey the first recording medium, wherein the first guide member has a first accommodating portion defined to accommodate one of the rollers of the first roller pair in the state in which the first guide member is in the second posture.

8. The image recording apparatus according to claim 1, further comprising a second roller pair constituted by a pair of rollers and provided on the first convey path at a position near a position at which the tray is inserted, the second roller pair being configured to change a posture thereof between (a) a third posture in which the pair of rollers contact with each other and (b) a fourth posture in which the pair of rollers are distant from each other, and the second roller pair being further configured to nip and convey the first recording medium in the state in which the second roller pair is in the third posture, wherein the posture change mechanism is configured to change the posture of the support member and the first guide member to the first posture when the second roller pair is in the third posture, and change the posture of the support member and the first guide member to the second posture when the second roller pair is in the fourth posture.

9. The image recording apparatus according to claim 8, wherein the second roller pair includes, as the pair of rollers, a first roller and a second roller disposed on a lower side of the first roller so as to be opposed to the first roller and movable between (a) a first position at which the second roller contacts with the first roller in the state in which the second roller pair is in the third posture and (b) a second position which is lower than the first position and at which the second roller is distant from the first roller in the state in which the second roller pair is in the fourth posture, and wherein the posture change mechanism includes:

a roller moving mechanism configured to move the second roller between the first position and the second position; and an interlock mechanism configured to change the posture of the support member and the first guide member from the first posture to the second posture by being interlocked with the movement of the second roller from the first position to the second position by the roller moving mechanism.

10. The image recording apparatus according to claim 1, further comprising:

a supply tray which is disposed on a lower side of the second convey path and on which the first recording medium is placed;

an arm having one end portion whose pivotal shaft is disposed between the second convey path and the supply tray, the arm being pivotable between (a) a fifth posture in which a distal end part of the other end portion of the arm is located nearer to the supply tray than to the second guide member and (b) a sixth posture in which the distal end part is located nearer to the second guide member than to the supply tray; and a supply roller rotatably provided on the distal end part of the arm so as to supply, to the first convey path, the first recording medium placed on the supply tray, wherein the second guide member has an opening portion which is penetrated by at least a part of the supply roller in the state in which the arm is in the sixth posture, and wherein the first guide member has a second accommodating portion defined to accommodate at least a part of the supply roller penetrating the opening portion.

* * * * *